US008664879B2

(12) United States Patent
Chen et al.

(10) Patent No.: US 8,664,879 B2
(45) Date of Patent: Mar. 4, 2014

(54) CIRCUIT FOR DRIVING FLUORESCENT LAMP AND LIGHT-EMITTING DIODE

(75) Inventors: Wei Chen, Panyu (CN); Yanshun Xue, Panyu (CN); Yilong Ye, Panyu (CN); Guoji Zhong, Panyu (CN)

(73) Assignee: OSRAM AG, Munich (DE)

( * ) Notice: Subject to any disclaimer, the term of this patent is extended or adjusted under 35 U.S.C. 154(b) by 75 days.

(21) Appl. No.: 13/437,014

(22) Filed: Apr. 2, 2012

(65) Prior Publication Data

US 2012/0248994 A1 Oct. 4, 2012

(30) Foreign Application Priority Data

Apr. 2, 2011 (CN) ..... 2011 1 0090145

(51) Int. Cl.
*H05B 37/00* (2006.01)
*H05B 35/00* (2006.01)

(52) U.S. Cl.
USPC ..... 315/278; 315/182; 315/209 R

(58) Field of Classification Search
USPC ..... 315/182
See application file for complete search history.

(56) References Cited

U.S. PATENT DOCUMENTS

| | | | | |
|---|---|---|---|---|
| 6,400,104 | B1 * | 6/2002 | Ham, II | 315/312 |
| 7,759,880 | B2 * | 7/2010 | Maros et al. | 315/307 |
| 8,264,159 | B2 * | 9/2012 | Dellian et al. | 315/209 CD |
| 8,294,384 | B2 * | 10/2012 | Matsuda | 315/291 |
| 8,354,803 | B2 * | 1/2013 | Newman et al. | 315/291 |
| 2005/0195600 | A1 | 9/2005 | Porchia et al. | |
| 2006/0290299 | A1 * | 12/2006 | Busse et al. | 315/312 |
| 2010/0164389 | A1 | 7/2010 | Dellian et al. | |

FOREIGN PATENT DOCUMENTS

| | | | |
|---|---|---|---|
| EP | 2163139 | B1 | 3/2011 |
| WO | 2009003509 | A1 | 1/2009 |
| WO | 2009111201 | A2 | 9/2009 |

* cited by examiner

*Primary Examiner* — Shawki Ismail
*Assistant Examiner* — Nelson Correa

(57) ABSTRACT

Proposed is a circuit for driving a fluorescent lamp and a light-emitting diode. The circuit may include an inverter; a fluorescent lamp driving branch for driving a fluorescent lamp; a light-emitting diode driving branch for driving a light-emitting diode; a starting branch; and an alternate control branch. By using a simple circuit structure, various embodiments may realize a circuit capable of conveniently and alternately driving a fluorescent lamp and a light-emitting diode.

10 Claims, 3 Drawing Sheets

CIRCUIT FOR DRIVING FLUORESCENT LAMP AND LIGHT-EMITTING DIODE

CROSS-REFERENCE TO RELATED APPLICATION

This application claims priority to Chinese Patent Application Serial No. 201110090145.1, which was filed Apr. 2, 2011, and is incorporated herein by reference in its entirety.

TECHNICAL FIELD

Various embodiments relate to a circuit for diving fluorescent lamp and a light-emitting diode (LED).

BACKGROUND

To save electricity, it is generally needed to be switched between main lighting realized by fluorescent lamps and weak lighting realized by LEDs. However, to switch between main lighting and weak lighting, a fluorescent lamp driver and an LED driver are needed for separately driving the fluorescent lamps that realize main lighting and the LEDs that realize weak lighting.

Circuits and methods for driving fluorescent lamps and LEDs have been developed.

For example, the patent EP2163139B2 in the title of "CIRCUIT ARRANGEMENT AND METHOD FOR OPERATING AT LEAST ONE LED AND AT LEAST ONE FLUORESCENT LAMP" discloses a circuit and method for driving at least one fluorescent lamp and at least one LED.

FIG. 1 schematically shows a structure of a circuit according to the above mentioned patent. Input terminals E1, E2 are coupled to a power supply AC voltage UN by means of a switch S. The input terminals E1, E2 are coupled to a main rectifier 12, the input terminal E1 is also coupled to a first input terminal of an auxiliary rectifier 14 via a capacitor CS1, and the second input terminal E2 is coupled to a second input terminal of the auxiliary rectifier 14 via a second capacitor CS2. The two input terminals of the auxiliary rectifier are directly coupled to an X capacitor CX1. An output end of an inverter is coupled to a fluorescent lamp LA, wherein the capacitor C5 is designed as a triggering capacitor. Moreover, the input terminals E1, E2 of the main rectifier 12 are coupled to an input end of a timer 20, a first output end of the timer 20 is coupled to a control electrode of an LED switch Q3, and a second output end thereof is coupled to a reference electrode of the LED switch Q3. As is depicted by dashes, a coupling of the timer 20 to the operating electrode of the LED switch Q3 can be provided. A starting capacitor C1 is coupled between the output ends A13 and A14 of the auxiliary rectifier 14, a voltage UC1 being stored in the starting capacitor. Coupled in parallel with the starting capacitor C1 is the series circuit formed by a plurality of LEDs (illustrated by the LEDs LD5 and LD6), and also the path operating electrode-reference electrode of the LED switch Q3. Moreover, the voltage UC1 is coupled to one terminal of the DIAC D14, the other terminal of which is coupled to a control electrode of a switch of the inverter 16. The midpoint of the inverter 16, which includes at least two switches (not illustrated), is coupled to the voltage UC1 via a pull-down circuit 22.

The circuit shown in FIG. 1 alternately drives the fluorescent lamp and the light-emitting diode by using two rectifiers (i.e., the main rectifier 12 and the auxiliary rectifier 14) under the control of the timer 20. Thus, the circuit is complicate.

Therefore, there is a need of a circuit and method capable of simply and conveniently driving a fluorescent lamp and a light-emitting diode.

SUMMARY

Proposed is a circuit for driving a fluorescent lamp and a light-emitting diode. The circuit may include an inverter; a fluorescent lamp driving branch for driving a fluorescent lamp; a light-emitting diode driving branch for driving a light-emitting diode; a starting branch; and an alternate control branch. By using a simple circuit structure, various embodiments may realize a circuit capable of conveniently and alternately driving a fluorescent lamp and a light-emitting diode.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
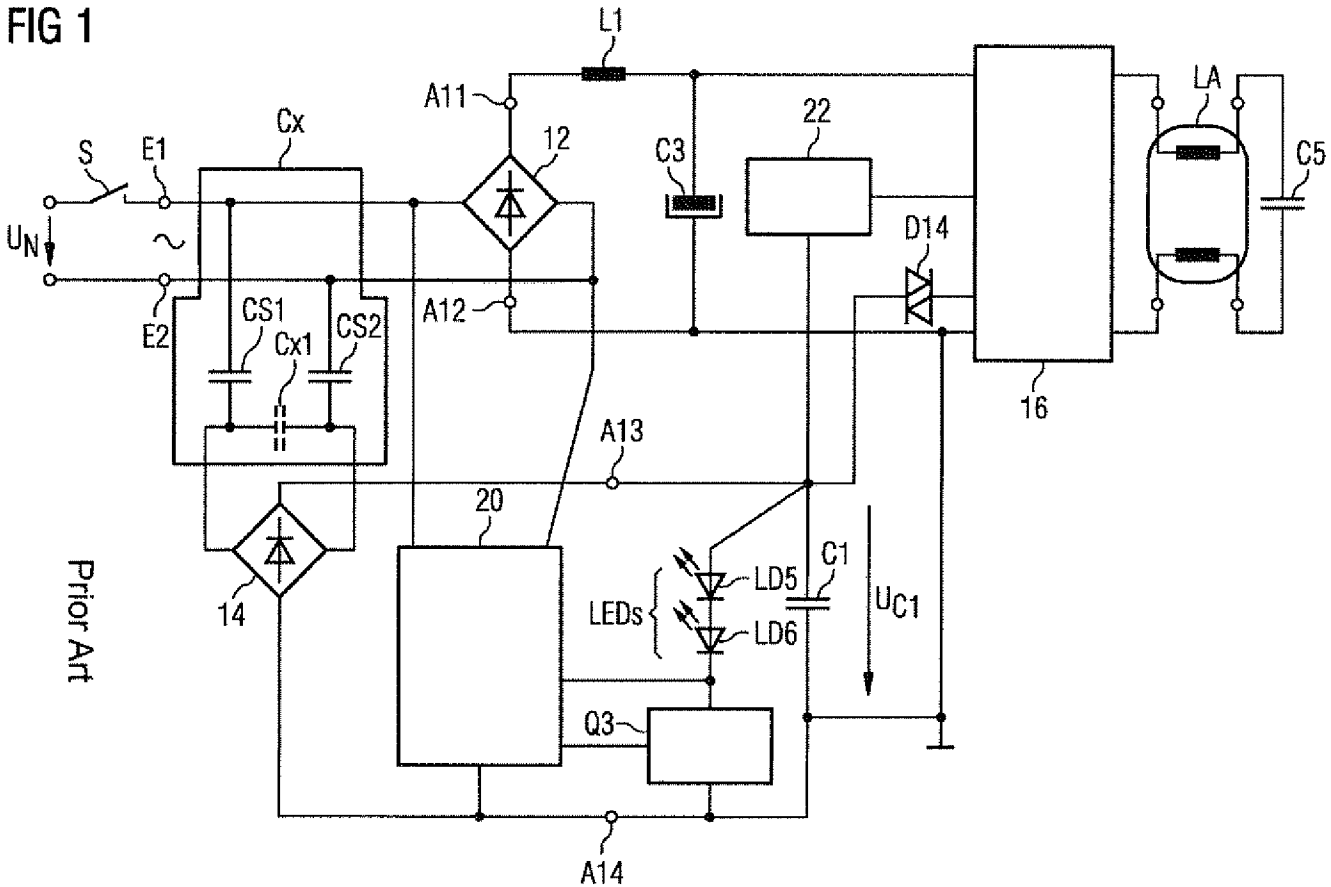
FIG 1 Prior Art
FIG. 1 shows a structure of a circuit according to the prior art.

By the detailed descriptions referring to the Drawings below, the present invention will be understood more easily. The same reference number throughout the specification indicates elements having the same structure. The descriptions below made by making a reference to the accompanying drawings are provided for a comprehensive understanding of the exemplary embodiments of the present invention. These descriptions include all details to facilitate understanding the present invention, and should be considered to be only exemplary. Accordingly, those skilled in the art will understand that various changes and modifications to the embodiments described herein can be made without departing from the scope and spirit of the present invention. Similarly, for clarity and conciseness, descriptions of the common function and structure are omitted.

The terms used herein are only used for describing the embodiments, but are not intended to limit the present invention. Unless being explicitly defined, all the terms (comprising technical and scientific terms) used herein have the same meanings as those generally understood by those skilled in the art in the present invention.

Various embodiments will be described in detail with reference to the accompanying drawings.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g.

in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments may solve the above-mentioned defects and problems in the prior art.

Various embodiments may at least solve the above-mentioned defects and realizes a circuit capable of conveniently and alternately driving a fluorescent lamp and a light-emitting diode by using a simpler circuit structure.

According to various embodiments, a circuit for driving a fluorescent lamp and a light emitting diode (LED) is provided. The circuit may include an inverter; a fluorescent lamp driving branch for driving a fluorescent lamp, connected to an output end of the inverter, and including a first inductor, a first capacitor, a second capacitor, and an MOSFET transistor that are connected in series; a light-emitting diode (LED) driving branch for driving a light-emitting diode, connected to the output end of the inverter; a starting branch including a first resistor, a third capacitor, a first diode and a DIAC, wherein one end of the first resistor is connected to a power source and another end thereof is connected to one end of the third capacitor, the another end of the third capacitor is grounded; the first diode is connected between a node between the first resistor and the third capacitor and a midpoint between an upper switch and a lower switch of the inverter; and the DIAC is connected between a node between the first resistor and the third capacitor and a control electrode of the lower switch; and an alternate control branch including second to sixth resistors, a fourth capacitor, first and second clamping diodes, a thyristor and the MOSFET transistor, wherein the second resistor and the third resistor are connected in series between the power source and the ground; the fourth capacitor is connected in parallel with the third resistor, and a non-grounded end of the fourth capacitor is connected to a gate of the thyristor via the first clamping diode and the fourth resistor; an anode of the thyristor is connected to a node between the fifth resistor and the sixth resistor that are connected in parallel with the third capacitor, and a cathode thereof is connected to the ground; and an end of the fourth resistor that is connected to the thyristor is further connected to a control electrode of the MOSFET transistor and connected to the ground via the second clamping diode.

In various embodiments, a time constant of the first resistor and the third capacitor is smaller than a time constant of the second resistor, the third resistor and the fourth capacitor.

In various embodiments, the light-emitting diode driving branch may include a second inductor, a second diode, a third diode and a fifth capacitor, wherein an end of a main winding of the second inductor is connected to the output end of the inverter, and another end thereof is grounded via a sixth capacitor; two auxiliary windings of the second inductor that are connected in parallel are connected to the second diode and the third diode, respectively, and both of them are connected in parallel with the fifth capacitor.

In various embodiments, the alternate control branch may further include a seventh capacitor connected in parallel with the sixth resistor.

In various embodiments, the fluorescent lamp driving branch may further include a fourth diode connected in parallel between an operating electrode and a reference electrode of the MOSFET transistor.

According to a second aspect of the present invention, a circuit for driving a fluorescent lamp and a light-emitting diode may be provided, this circuit merely differs from the circuit according to the first aspect of the present invention in that the light-emitting diode driving branch is connected between the first inductor and the fluorescent lamp.

Figure 2:
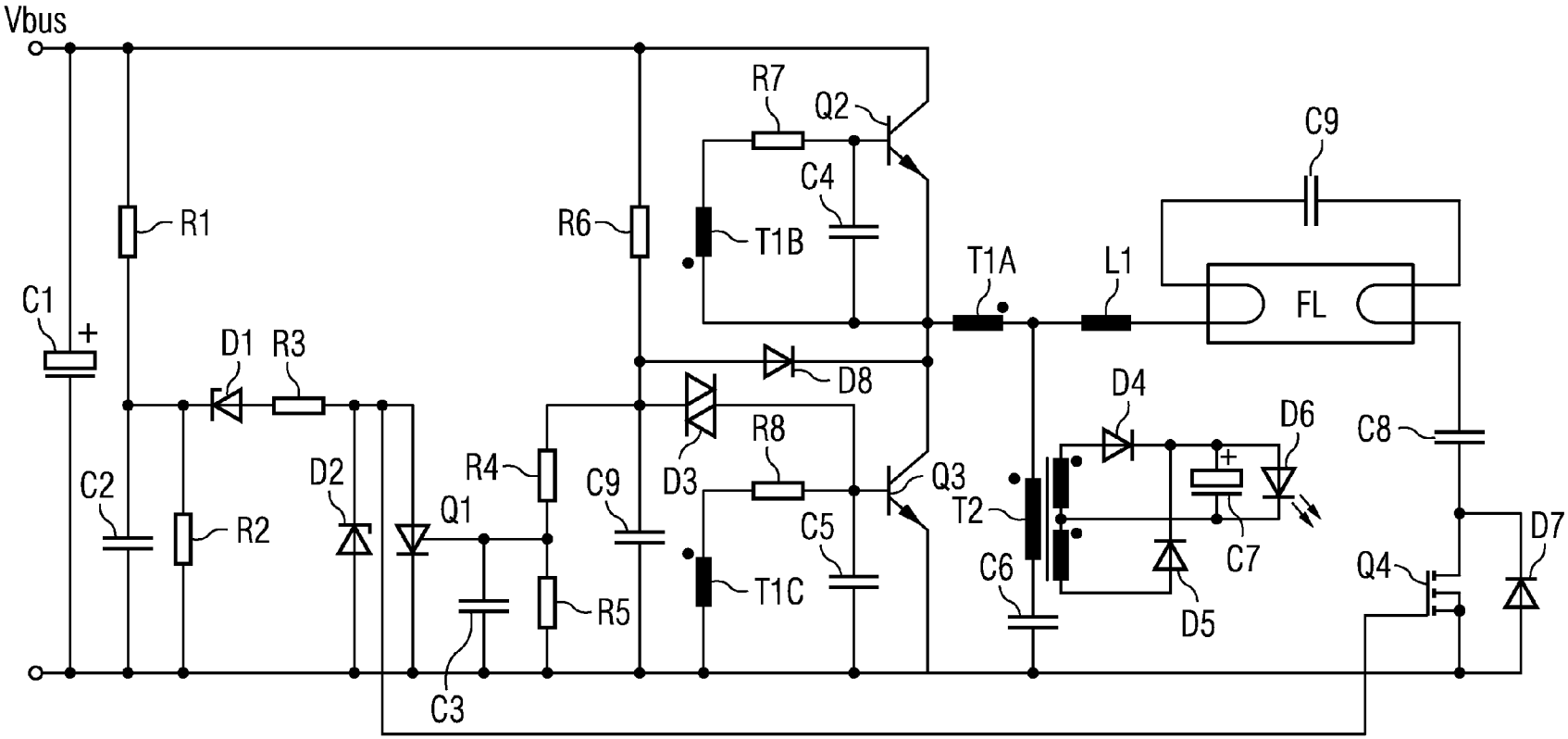
FIG. 2 shows a structure of a circuit for driving a fluorescent lamp and a light-emitting diode according to one embodiment of the present invention.

FIG. 2 shows a structure of a circuit for driving a fluorescent lamp and a light-emitting diode according to various embodiments.

The inverter including an upper switch Q2 and a lower switch Q3 is used for converting the DC power source Vbus into a high-frequency alternating current to be supplied to a driver of a fluorescent lamp FL and an inductor (i.e., the transformer) T2 of a light-emitting diode. As shown in FIG. 2, the upper switch Q2 and the lower switch Q3 are driven by means of auxiliary windings of the inductor T1, respectively. Although FIG. 2 shows that the inverter includes resistors R7, R8, capacitors C4, C5, the inverter may not be limited to this specific structure, and the person skilled in the art may use a full-bridge or half-bridge circuit having a suitable structure according to various embodiments.

The output of the inverter (via the main winding of the inductor T1) is connected to the fluorescent lamp driving branch for driving a fluorescent lamp FL. Although only one fluorescent lamp is shown in FIG. 2, there may also be a plurality of fluorescent lamps according to the requirement. As shown in FIG. 2, the fluorescent lamp driving branch comprises an inductor L1, capacitors C9, C8 and an MOSFET transistor Q4 that are connected in series. In various embodiments, the fluorescent lamp driving branch may further include a diode Q7 connected in parallel between the operating electrode and the reference electrode of the MOSFET transistor Q4.

The output of the inverter is also connected to the light-emitting diode driving branch for driving a light-emitting diode. Although only one light-emitting diode is shown in FIG. 2, there may also be a plurality of light-emitting diodes according to the requirement. As shown in FIG. 2, the light-emitting diode driving branch comprises an inductor (or transformer) T2, diodes D4 and D5, and a capacitor C7, wherein an end of a main winding of the inductor T2 is connected to the output of the inverter, and another end thereof is grounded via a capacitor C6; two auxiliary windings of the inductor (T2) that are connected in parallel are connected to the diodes D4 and D5, respectively, and both of them are connected in parallel with the capacitor C7. It is common to the person skilled in the art that the light-emitting diode driving circuit is not limited to the specific structure shown in FIG. 2, it may use any other suitable structure.

The circuit according to various embodiments may further include a starting branch including a resistor R6, a capacitor C9, a diode D8 and a DIAC (two-end alternating-current switch) D3. One end of the resistor R6 is connected to a power source Vbus and another end thereof is connected to the capacitor C9, the another end of the capacitor C9 is grounded; the diode D8 is connected between a node between the resistor R6 and the capacitor C9 and a midpoint between the upper switch Q2 and the lower switch Q3; and the DIAC D3 is connected between a node between the resistor R6 and the capacitor C9 and a control electrode of the lower switch Q3.

The circuit according to various embodiments may further include an alternate control branch for controlling main lighting and weak lighting so as to alternately realize the main lighting and the weak lighting. The alternate control branch may include resistors R1-R5, a capacitor C2, clamping diodes D1, D2, a thyristor Q1 and an MOSFET transistor Q4, wherein the resistors R1 and R2 are connected in series between the power source Vbus and the ground; the capacitor C2 is connected in parallel with the resistor R2, and a non-grounded end of the capacitor C2 is connected to a gate of the thyristor Q1 via the clamping diode D1 and the resistor R3; an anode of the thyristor Q1 is connected to a node between the resistors R4 and R5 that are connected in parallel with the third capacitor C9, and a cathode thereof is connected to the ground; and an end of the resistor R3 that is connected to the thyristor Q1 is further connected to a control electrode of the MOSFET transistor Q4 and connected to the ground via the clamping diode D2. In addition, a capacitor C3 may be connected in parallel between two ends of the resistor R5.

It should be noted that a time constant T1 of the resistor R6 and the capacitor C9 and a time constant T2 of the resistors R1, R2 and the capacitor C2 should be properly selected such that the time constant T1 is smaller than the time constant T2.

By using the above circuit, when the power source Vbus is turned on for the first time, the capacitor C9 is charged up and the DIAC D3 is triggered. At this moment, the voltage at two ends of the capacitor C2 has not reached the level for turning on the diode D1 to supply a trigger current to the thyristor Q1, resulting in that the thyristor is in an OFF state after being started. After the capacitor C2 has been finally charged, the MOSFET transistor Q4 is turned on. Therefore, both the fluorescent lamp FL and the LED D6 have been turned on, thereby providing the main lighting.

When the power source Vbus is turned off and is immediately turned on, since the value of the time constant T2 is relatively big, the voltage at two ends of the capacitor C2 is still maintained at high voltage, and after having been further charged from the power source Vbus, the capacitor C2 can supply a trigger current to the thyristor Q1. The thyristor Q1 is turned on due to the supplied trigger current, and the voltage of the control electrode of the MOSFET transistor Q4 is pulled down, thereby turning off the transistor Q4. In this case, the fluorescent lamp FL does not light, and only the LED is turned on for weak lighting.

Therefore, it is easy to realize switching between the main lighting and the weak lighting by using this circuit, thereby achieving the purpose of saving electricity and realizing proper lighting requirement.

Figure 3:
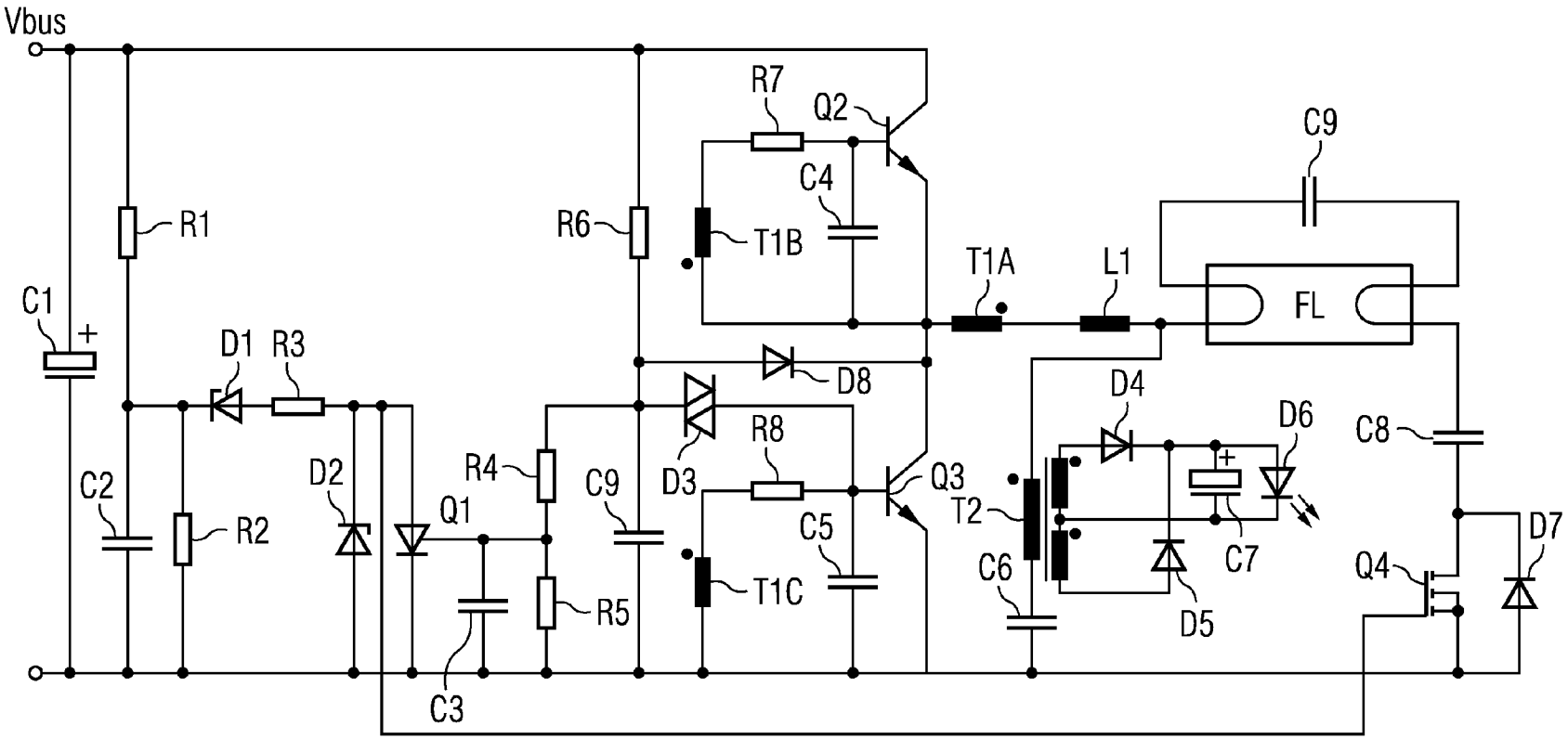
FIG. 3 shows a structure of a circuit for driving a fluorescent lamp and a light-emitting diode according to another embodiment of the present invention.

FIG. 3 shows a structure of a circuit for driving a fluorescent lamp and a light-emitting diode according to various embodiments. Since most of the components in FIG. 3 and their connection relations are the same as that in FIG. 2, detailed depiction of these components are omitted. The circuit shown in FIG. 3 merely differs from the circuit shown in FIG. 2 in that the inductor (transformer) T2 of the light-emitting diode driving branch is connected between the inductor L1 of the fluorescent lamp driving branch and the fluorescent lamp.

By using the circuit according to various embodiments as shown in FIG. 3, when the power source Vbus is turned on for the first time, the capacitor C9 is charged up and the DIAC D3 is triggered, so the light-emitting diode D6 is turned on. At this moment, the voltage at two ends of the capacitor C2 has not reached the level for turning on the diode D1 to supply a trigger current to the thyristor Q1, resulting in that the thyristor is in an OFF state after being started. After the capacitor C2 has been finally charged, the MOSFET transistor Q4 is turned on, thereby turning on the fluorescent lamp FL. Once the fluorescent lamp FL is turned on, the light-emitting diode D6 is turned off immediately, thus merely the fluorescent lamp is turned on to provide the main lighting.

When the power source Vbus is turned off and is immediately turned on, since the value of the time constant T2 is relatively big, the voltage at two ends of the capacitor C2 is still maintained at high voltage, and after having been further charged from the power source Vbus, the capacitor C2 can supply a trigger current to the thyristor Q1. The thyristor Q1 is turned on due to the supplied trigger current, and the voltage of the control electrode of the MOSFET transistor Q4 is pulled down, thereby turning off the transistor Q4. In this case, the fluorescent lamp FL does not light, and only the LED is turned on for weak lighting.

Therefore, it is easy to realize switching between the main lighting and the weak lighting by using this circuit, thereby achieving the purpose of saving electricity and realizing proper lighting requirement.

Although this Description contains details of many specific embodiments, these details shall not be construed as limiting the scope of any invention or contents that can be claimed, but shall be construed as describing features of specific embodiments that can be specified in a specific invention.

The above specific embodiments do not limit the scope of protection of the present invention. Those skilled in the art can understand that various amendments, combinations, subcombinations and substitutions can be made depending on requirements for design and other factors. Any amendments, equivalent substitutions, improvements, etc. made within the spirit and principle of the present invention shall be contained in the scope of protection of the present invention.

What is claimed is:

1. A circuit for driving a fluorescent lamp and a light-emitting diode, the circuit comprising:

an inverter;

a fluorescent lamp driving branch for driving a fluorescent lamp, connected to an output end of the inverter, and including a first inductor, a first capacitor, a second capacitor, and an MOSFET transistor that are connected in series;

a light-emitting diode driving branch for driving a light-emitting diode, connected to the output end of the inverter;

a starting branch comprising a first resistor, a third capacitor, a first diode and a DIAC, wherein one end of the first resistor is connected to a power source and another end thereof is connected to one end of the third capacitor, the another end of the third capacitor is grounded; the first diode is connected between a node between the first resistor and the third capacitor and a midpoint between an upper switch and a lower switch of the inverter; and the DIAC is connected between a node between the first resistor and the third capacitor and a control electrode of the lower switch; and an alternate control branch comprising second to sixth resistors, a fourth capacitor, first and second clamping diodes, a thyristor and the MOSFET transistor, wherein the second resistor and the third resistor are connected in series between the power source and the ground; the fourth capacitor is connected in parallel with the third resistor, and a non-grounded end of the fourth capacitor is connected to a gate of the thyristor via the first clamping diode and the fourth resistor; an anode of the thyristor is connected to a node between the fifth resistor and the sixth resistor that are connected in parallel with the third capacitor, and a cathode thereof is connected to the ground; and an end of the fourth resistor that is connected to the thyristor is further connected to the control electrode of the MOSFET transistor and is connected to the ground via the second clamping diode.

2. The circuit according to claim 1, wherein a time constant of the first resistor and the third capacitor is smaller than a time constant of the second resistor, the third resistor and the fourth capacitor.

3. The circuit according to claim 1, wherein the light-emitting diode driving branch comprises a second inductor, a second diode, a third diode and a fifth capacitor, wherein an end of a main winding of the second inductor is connected to the output end of the inverter, and another end thereof is grounded via a sixth capacitor; two auxiliary windings of the second inductor that are connected in parallel are connected to the second diode and the third diode, respectively, and both of them are connected in parallel with the fifth capacitor.

4. The circuit according to claim 1, wherein the alternate control branch further comprises a seventh capacitor connected in parallel between two ends of the sixth resistor.

5. The circuit according to claim 1, wherein the fluorescent lamp driving branch further comprises a fourth diode connected in parallel between an operating electrode and a reference electrode of the MOSFET transistor.

6. A circuit for driving a fluorescent lamp and a light-emitting diode, the circuit comprising:

an inverter;

a fluorescent lamp driving branch for driving a fluorescent lamp, connected to an output end of the inverter, and including a first inductor, a first capacitor, a second capacitor, and an MOSFET transistor that are connected in series;

a light-emitting diode driving branch for driving a light-emitting diode, connected to between the first inductor and the fluorescent lamp;

a starting branch comprising a first resistor, a third capacitor, a first diode and a DIAC, wherein one end of the first resistor is connected to a power source and another end thereof is connected to one end of the third capacitor, the another end of the third capacitor is grounded; the first diode is connected between a node between the first resistor and the third capacitor and a midpoint between an upper switch and a lower switch of the inverter; and the DIAC is connected between a node between the first resistor and the third capacitor and a control electrode of the lower switch; and an alternate control branch comprising second to sixth resistors, a fourth capacitor, first and second clamping diodes, a thyristor and the MOSFET transistor, wherein the second resistor and the third resistor are connected in series between the power source and the ground; the fourth capacitor is connected in parallel with the third resistor, and a non-grounded end of the fourth capacitor is connected to a gate of the thyristor via the first clamping diode and the fourth resistor; an anode of the thyristor is connected to a node between the fifth resistor and the sixth resistor that are connected in parallel with the third capacitor, and a cathode thereof is connected to the ground; and an end of the fourth resistor that is connected to the thyristor is further connected to a control electrode of the MOSFET transistor and is connected to the ground via the second clamping diode.

7. The circuit according to claim 6, wherein a time constant of the first resistor and the third capacitor is smaller than a time constant of the second resistor, the third resistor and the fourth capacitor.

8. The circuit according to claim 6, wherein the light-emitting diode driving branch comprises a second inductor, a second diode, a third diode and a fifth capacitor, wherein an end of a main winding of the second inductor is connected between the first inductor and the fluorescent lamp, and another end thereof is grounded via a sixth capacitor; two auxiliary windings of the second inductor that are connected in parallel are connected to the second diode and the third diode, respectively, and both of them are connected in parallel with the fifth capacitor.

9. The circuit according to claim 6, wherein the alternate control branch further comprises a seventh capacitor connected in parallel between two ends of the sixth resistor.

10. The circuit according to claim 6, wherein the fluorescent lamp driving branch further comprises a fourth diode connected in parallel between an operating electrode and a reference electrode of the MOSFET transistor.

* * * * *